US005520879A

United States Patent [19]

Saito et al.

[11] Patent Number: 5,520,879

[45] Date of Patent: May 28, 1996

[54] SINTERED POWDERED TITANIUM ALLOY AND METHOD OF PRODUCING THE SAME

[75] Inventors: Takashi Saito; Tadahiko Furuta, both of Aichi, Japan

[73] Assignee: Kabushiki Kaisha Toyota Chuo Kenkyusho, Aichi-ken, Japan

[21] Appl. No.: 371,417

[22] Filed: Jan. 11, 1995

Related U.S. Application Data

[62] Division of Ser. No. 789,822, Nov. 8, 1991, Pat. No. 5,409,518.

[30] Foreign Application Priority Data

| | | | |
|---|---|---|---|
| Nov. 9, 1990 | [JP] | Japan | 2-304874 |
| Nov. 30, 1990 | [JP] | Japan | 2-338952 |
| Sep. 2, 1991 | [JP] | Japan | 3-250436 |
| Sep. 19, 1991 | [JP] | Japan | 3-269022 |

[51] Int. Cl.[6] ..... B22F 3/16

[52] U.S. Cl. ..... 419/38; 419/12

[58] Field of Search ..... 419/38, 12

[56] References Cited

PUBLICATIONS

Dixon, et al, "Powder Metallurgy for Engineers" Machinery Publishing Co. Ltd., 1971, pp. 30–47.

*Primary Examiner*—Donald P. Walsh
*Assistant Examiner*—Daniel Jenkins
*Attorney, Agent, or Firm*—Oblon, Spivak, McClelland, Maier & Neustadt

[57] ABSTRACT

A sintered titanium alloy is composed of a titanium matrix or titanium alloy matrix and hard particles dispersed in the matrix, the sintered titanium alloy comprises: 4–8 mass % of aluminum (Al); 2–6 mass % of vanadium (V); 0.15–0.8 mass % of oxygen (O); at least one element selected from the group consisting of 0.2–9 mass % of boron (B), 0.5–3 mass % of at least one of molybdenum (Mo), tungsten (W), tantalum (Ta), zirconium (Zr), niobium (Nb), and hafnium (Hf), 0.05–2 mass % of at least one of Ia Group elements, IIa Group elements, and IIIa Group elements, 0.05–0.5 mass % of at least one of halogens; with the balance being titanium (Ti) and inevitable impurities. A method for economically producing a high-density sintered titanium alloy comprises mixing a raw material powder composed of a titanium powder and a powder for solid-solution hardening, rubbing and pressing the titanium powder before, during or after the mixing, so as to cause the raw material powder to have a desired tap density, compacting the mixed powder, and sintering the green compact under no pressure.

25 Claims, 5 Drawing Sheets

(x 500)

(x 200)

(x 200)

(x 500)

(X 200)

(X 500)

(x 200)

(x 1000)

SINTERED POWDERED TITANIUM ALLOY AND METHOD OF PRODUCING THE SAME

This is a Division, of application Ser. No. 07/789,822 filed on Nov. 8, 1991, now U.S. Pat. No. 5,409,518.

BACKGROUND OF THE INVENTION

1. Field of the Invention

The present invention relates to an inexpensive, high-strength powder metallurgy titanium alloy and to a method of producing the same.

2. Description of the Related Art

Titanium alloys have a higher specific strength and specific toughness than ultrahigh-strength steel and high-strength aluminum alloys. On the other hand, they are poor in yield because of their difficulties involved in melting, casting, and machining. This has led one to believe that they are unsuitable for mass-produced parts.

It seems possible to overcome these difficulties by employing powder metallurgy, which permits the production of parts that need only a few finishing steps. Of many powder metallurgy methods, a promising one is the mixed powder method which involves the mixing of pure titanium powder and strengthening powder, which is followed by compacting and sintering. This method offers several advantages, including inexpensive raw material powder, high yields, and simple production process, which will lead to a considerable cost saving. The conventional mixed powder method, however, suffers from a disadvantage that it gives rise to a sintered titanium alloy which is as poor as cast materials in mechanical properties, especially fatigue strength. Therefore, it can be applied to the production of small components (such as nuts, fasteners, and filters) and missile parts (such as dome housings and gyroscope gimbals) which do not need high fatigue strength, but it cannot be applied to the production of important parts which need high fatigue strength.

In order to address this problem, various attempts have recently been made to improve fatigue strength by using a ultrahigh-purity titanium powder as a raw material and carrying out hot isostatic pressing and heat treatment after sintering.

Among the improved methods is "Production of titanium alloys by the mixed powder method" proposed in Japanese Patent Publication No. 29864/1989. This method consists of mixing the constituent metal powders, compacting the mixture, vacuum-sintering the compact, thereby forming a sintered titanium alloy, quenching the sintered compact from the β-transus temperature (which is far below the sintering temperature) to room temperature or below, and finally heating the quenched compact under pressure at a temperature between 800° C. and the β-transus temperature (at which the α+β two-phase region exists), thereby removing residual pores. In other words, this method involves the strengthening of sintered titanium alloy by the subtle combination of hot isostatic pressing and heat treatment. Therefore, this method, which is the mixed powder method, provides a sintered titanium alloy similar to that obtained by the alloyed powder method. The resulting sintered titanium alloy has a fine, homogeneous microstructure and a high fatigue strength.

Both the alloyed powder method and the mixed powder method provide their respective α+β alloys through hot isostatic pressing. However, the α+β alloys differ in microstructure because the sintered compacts before hot isostatic pressing differ in microstructure. The alloyed powder method employs an alloy powder prepared by quenching, which is subsequently solidified as such at a temperature below the β-transus temperature. Therefore, the tempering of martensite takes place during hot isostatic pressing, giving rise to the fine α+β microstructure. By contrast, the mixed powder method provides a sintered titanium alloy which has a coarse acicular α-phase due to β/α transformation which takes place in the cooling step which follows sintering. This sintered titanium alloy remains unchanged in microstructure even after hot isostatic pressing at a temperature below the β-transus temperature.

According to Japanese Patent Publication No. 29864/1989 cited above, this disadvantage is eliminated by performing β-quenching after sintering, thereby changing the microstructure into the fine martensite, and then performing hot isostatic pressing. This process is greatly affected by residual pores. The sintered compact contains residual pores which account for about 5 vol %. They completely suppress the grain growth of β-phase during the solution treatment which is performed in the β-region. Therefore, quenching provides a fine martensite microstructure and the subsequent hot isostatic pressing in the α+β two-phase region forms the fine α-phase with a small aspect ratio similar to that provided by the alloyed powder method. The method disclosed in Japanese Patent Publication No. 29864/1989 cited above employs a titanium powder with an extremely low chlorine content which leaves no residual pores at all, so that the resulting titanium alloy is comparable in fatigue strength to that obtained by the alloyed powder method.

According to the method disclosed in Japanese Patent Publication No. 29864/1989 cited above, it is possible to improve the mechanical properties of sintered titanium alloys by the combination of hot isostatic pressing and heat treatment. This method, however, has a disadvantage of needing an expensive extra low chlorine powder as a raw material and needing the hot isostatic pressing and heat treatment after sintering. This disadvantage, which inevitably leads to a marked cost increase, makes the method unsuitable for the mass production of cheap automotive parts and the like.

Another method of producing a sintered titanium alloy is disclosed in Japanese Patent Publication No. 50172/1990 entitled "Method for producing a high-density sintered titanium alloy". This method involves the steps of (a) preparing alloy-forming particles (0.5–20 μm in average particle diameter) by using a pulverizer capable of providing high energy, (b) mixing the alloy-forming particles with titanium base metal particles (40–177 μm in average particle diameter), thereby forming a powder mixture in which the titanium base metal powder accounts for 70–95%, with the balance being the alloy-forming particles, and (c) forming the powder mixture into a green compact and sintering it at a temperature below that at which the liquid phase appears. It is claimed in this disclosure that the mechanical energy given during disintegration is accumulated as strain energy in the powder and this strain energy promotes sintering, giving rise to a relative density higher than 99%, without requiring any other steps than compacting and sintering, and that the resulting sintered alloy has much better mechanical properties as compared with that obtained by the ordinary method.

However, the above-mentioned claim is not convincing because the ordinary mother alloy such as $Al_3V$ is hardly capable of plastic deformation and hence incapable of accumulating in the powder during disintegration so much energy as to promote sintering. The densification achieved by this method is due to the fact that the mother alloy powder decreases in average particle diameter and increases in surface energy in the pulverizing step. The promotion of sintering by pulverization is a known fact, and the fatigue strength attained by this method is 40 kg/mm$^2$ at the highest (even when the compacting pressure is increased) although it is higher than that attained by the conventional method.

Japanese Patent Laid-open No. 130732/1988 discloses "Method for producing a high-density sintered titanium alloy", which involves the mixing of a titanium powder or titanium alloy powder composed of 25 wt % or more particles finer than 325 mesh with an alloying powder finer than 325 mesh in a prescribed ratio, which is followed by mechanical pulverization, compacting, and sintering. According to this disclosure, the mixture of a titanium powder and a mother alloy powder is pulverized in a high-energy ball mill so that the finely ground particles mechanically aggregate to form larger particles, and the thus prepared powder yields a high-density sintered body after compacting and sintering.

The copulverization of a titanium powder and a mother alloy powder, as disclosed in Japanese Patent Laid-open 130732/1988 cited above, needs a very large amount of energy to greatly deform and pulverize the highly ductile titanium powder. This leads to a disadvantage that the greatly deformed titanium powder undergoes marked work hardening and hence decreases in compressibility. This in turn makes it necessary to increase the forming pressure to such a level which is by far higher than that required in the ordinary process, in order to increase the density of the compact. It is known that intensive working following pulverization brings about aggregation, and the aggregate powder has such a simple shape that it is very poor in forming performance. An additional disadvantage of this method is that the active titanium powder inevitably takes up a large amount of oxygen in the pulverizing step. The absorbed oxygen has an adverse effect on mechanical properties, especially ductility, of the sintered titanium alloy.

The above-mentioned prior arts are based on the known titanium alloys developed for the ingot metallurgy, and hence they disclose nothing about the titanium alloys prepared by utilizing the feature of the mixed powder method.

In order to improve the heat resistance, stiffness, and wear resistance of sintered titanium alloys, a composite material has recent been developed which contains hard particles dispersed therein. The dispersed particles are those of TiC, TiN, SiC, and $TiB_2$. An example of the titanium-based composite material is disclosed in U.S. Pat. No. 4,731,115, entitled "Titanium carbide/titanium alloy composite and process for powder metal cladding". This disclosure concerns a titanium-based composite material containing TiC particles dispersed therein, which is produced from a titanium powder, mother alloy powder for solid-solution hardening, and TiC powder, by mixing, forming, sintering, and hot isostatic pressing. This disclosure also concerns a laminate of powder alloy. It is claimed that the composite material thus obtained has a high Young's modulus and good wear resistance.

The composite material disclosed in U.S. Pat. No. 4,731,115 cited above has a disadvantage of high production cost resulting from hot isostatic pressing. Another disadvantage includes decreased ductility and coarse grains. The decreased ductility is due to the fact that the titanium alloy matrix dissolves a considerable amount of carbon although TiC particles are less reactive to the matrix than SiC as a reinforcing fiber for titanium-based FRM. The coarse grains result from the Ostwald Ripening which is enhanced by incoherent interface between TiC particles and the titanium alloy matrix and the tendency of carbon toward dissolution in the matrix. In addition, this composite material has to be consolidated at a low temperature (with low-temperature, high-pressure hot isostatic pressing) to prevent the particle/matrix reaction and grain growth. Any violation of this condition will result in a composite material which has a high stiffness but is poor in ductility. It can be said, therefore, that TiC particles are not necessarily the best although they are by far superior to SiC particles in compatibility with the titanium alloy.

Japanese Patent Laid-open No. 129330/1990 entitled "Highly wear resistant titanium alloy material" discloses a titanium-based composite material containing TiC particles dispersed therein which is similar to that disclosed in U.S. Pat. No. 4,731,115 cited above. This alloy material is characterized by that the matrix alloy is of β phase. It claims that the titanium alloy material, in which the matrix is of β phase, is by far superior in wear resistance to that in which the matrix is the ordinary α+β titanium alloy.

The composite material containing TiC particles dispersed therein, which is disclosed in Japanese Patent Laid-open No. 129330/1990 cited above, has both improved wear resistance and improved ductility because it has the matrix of β-titanium alloy. Nevertheless, it has a disadvantage of high production cost. It has an additional disadvantage inherent in β-titanium alloy. A β-titanium alloy has a much lower Young's modulus than an α+β titanium alloy and hence it has the same stiffness as that of an ordinary α+β titanium alloy even though it contains reinforcing particles dispersed therein. Also, a β-titanium alloy is inherently poor in creep characteristics and hence it is poor in heat resistance even though it is incorporated with reinforcing particles.

U.S. Pat. No. 4,968,348 discloses "Titanium diboride/titanium alloy metal matrix microcomposite and process for powder metal cladding". According to this disclosure, the titanium-based composite material and powder alloy laminate are produced from a titanium alloy containing $TiB_2$ particles dispersed therein which is prepared by powder metallurgy similar to that disclosed in U.S. Pat. No. 4,731,155 cited above. The thus obtained alloy composite material is claimed to be superior in strength, stiffness, and wear resistance. A disadvantage of this composite material is that the production process involves sintering at a low temperature under a high pressure because $TiB_2$ is not in thermodynamic equilibrium with the titanium alloy. This limitation leads to a high production cost.

SUMMARY OF THE INVENTION

It is an object of the present invention to provide an inexpensive, high-strength sintered titanium alloy and a method for producing the same.

It is another object of the present invention to provide an inexpensive sintered titanium alloy superior in strength, ductility, stiffness, wear resistance, and heat resistance, and a method for producing the same.

In the course of their studies to solve problems involved in the prior art technology, the present inventors found that a sintered titanium alloy made by the mixed powder method will have a high strength even though it does not undergo hot isostatic pressing and heat treatment, if it has an adequate alloy composition and it is produced under adequate conditions so that the sintering alone forms fine residual pores and the slow cooling after sintering provides a fine microstructure.

To meet the above-mentioned requirements, the present inventors approached the problems from an entirely new view point with the following in mind.

The alloy should have a composition suitable for the mixed powder method. (In other words, the alloy composition should be different from the conventional one which was developed for ingot metallurgy.)

The titanium powder as a raw material should have a controlled shape so that it has an increased tap density as desired and forms fine residual pores accordingly.

Impurities and inclusions in titanium should be positively utilized to improve the characteristic properties. (In the prior art technology, they are regarded as something undesirable which aggravates the characteristic properties.)

The present invention is embodied in a sintered titanium alloy composed of a titanium matrix or titanium alloy matrix and hard particles dispersed in said matrix, said sintered titanium alloy comprising: 4–8 mass % of aluminum (Al); 2–6 mass % of vanadium (V); 0.15–0.8 mass % of oxygen (O); at least one element selected from the group consisting of 0.2–9 mass % of boron (B), 0.5–3 mass % of at least one of molybdenum (Mo), tungsten (W), tantalum (Ta), zirconium (Zr), niobium (Nb), and hafnium (Hf), 0.05–2 mass % of at least one of Ia Group elements, IIa Group elements, and IIIa Group elements, and 0.05–0.5 mass % of at least one of halogens; the balance being titanium (Ti) and inevitable impurities.

The sintered titanium alloy of the present invention exhibits a high strength. The mechanism for this is not elucidated yet. Each component plays an important role as explained in the following.

The aluminum (Al) contained in an amount of 4–8 mass % functions as an element for solid-solution hardening. It contributes to solid-solution hardening and α-phase stabilization. A content less than 4% is not enough to produce the hardening effect as desired; and a content more than 8% has an adverse effect on ductility.

The vanadium (V) contained in an amount of 2–6 mass % also functions as an element for solid-solution hardening. It contributes to solid-solution hardening and β-phase stabilization. A content less than 2% is not enough for the contribution to solid-solution hardening and β-phase stabilization desired. A content more than 6% leads to excessive β-phase stabilization.

The oxygen (O) contained in an amount of 0.15–0.8 mass % functions as an element for solid-solution hardening. (According to the conventional technology, oxygen is regarded as an element which has an adverse effect on ductility of a titanium alloy. Therefore, its content is strictly limited to 0.15%. This is not true in the case of a sintered titanium alloy prepared by the mixed powder method. In fact, oxygen affects ductility only a little but increases strength, although the reason is not known.) A content less than 0.15% is not enough to produce the hardening effect; and a content in excess of 0.8% leads to an extreme decrease in ductility.

The boron contained in an amount of 0.2–9 mass % remains undissolved in the titanium alloy. In other words, it is mostly dispersed in the form of fine TiB particles in the sintered body. A content less than 0.2% is not enough to cause sufficient TiB to precipitate. A content more than 9% leads to the separation of excess TiB, which has an adverse effect on ductility.

At least one of molybdenum (Mo), tungsten (W), tantalum (Ta), zirconium (Zr), niobium (Nb), and hafnium (Hf) is used, and the total amount thereof should preferably be 0.5–3 mass %. These elements make the transgranular α-phase extremely fine, because they are very slow in diffusion in the β-titanium alloy, they lower the β-transus temperature, and they lower the mobility of the β/α interface. A content less than 0.5 mass % may not be enough for them to produce the desired effect; and a content more than 3 mass % may lead to the insufficient homogenization of components in the course of sintering and also to an excessively lowered β-transus temperature.

At least one of Ia Group elements, IIa Group elements, and IIIa Group elements is used, the total amount thereof being 0.05–2 mass %. These elements are present for the most part in the form of oxides and halides because they combine more easily with oxygen and halogens than titanium does. The oxide particles and halide particles inhibit the growth of β-grains in the sintering step and promote the homogenous nucleation of α-phase in the cooling step that follows sintering, with the result that the α-phase in the sintered body becomes equiaxed and the intergranular α-phase disappears. A total content less than 0.05% is not enough for the oxides and halides to separate out; and a total content in excess of 2% results in coarse oxide particles and halide particles which are not dispersed uniformly.

At least one of the halogens is used, the total amount thereof being 0.05–0.5 mass %. The halogens combine with at least one of the Ia Group elements, IIa Group elements, and IIIa Group elements to form fine halide particles in the titanium alloy. The halide includes NaCl, $MgCl_2$, $CaCl_2$, $YCl_3$, KCl, and $BaCl_2$. A total amount less than 0.05% is not enough for the halides to precipitate; and a total amount in excess of 0.5% results in coarse halide particles which do not disperse uniformly but decrease ductility.

The sintered titanium alloy containing the above-mentioned elements is composed of a titanium matrix or titanium alloy matrix and hard particles dispersed therein, said hard particles being at least one of borides, oxides, and halides. This composition is considered to be responsible for the high strength of the sintered titanium alloy.

DETAILED DESCRIPTION OF THE INVENTION

Figure 1:
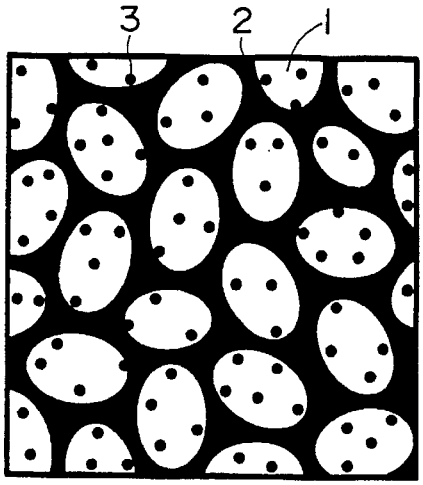
FIG. 1 is a schematic representation showing the microstructure of the sintered titanium alloy in one embodiment of the present invention.

According to a preferred embodiment of the present invention, the sintered titanium alloy is composed of three phases which are the α]phase, the β phase, and particles of at least one of borides, oxides, and halides, said sintered titanium alloy comprising: 4–8 mass % of aluminum (Al); 2–6 mass % of vanadium (V); 0.15–0.8 mass % of oxygen (O); at least one element selected from the group consisting of 0.2–9 mass % of boron (B), 0.5–3 mass % of at least one of molybdenum (Mo), tungsten (W), tantalum (Ta), zirconium (Zr), niobium (Nb), and hafnium (Hf), 0.05–2 mass % of at least one of Ia Group elements, IIa Group elements, and IIIa Group elements, and 0.05–0.5 mass % of at least one of halogens; the balance being titanium (Ti) and inevitable impurities.

This sintered titanium alloy should contain boron (B) in an amount of 0.2–1 mass %. Boron hardly dissolves in the titanium alloy but disperses for the most part into the matrix of the sintered body, .forming fine TiB particles. (TiB may partly changes into $TiB_2$ if there is carbon, however small its amount may be.) The fine TiB particles inhibit the growth of β grains during sintering and promote the homogeneous nucleation of the α phase during cooling which follows sintering, with the result that the α-phase in the sintered body becomes equiaxed and the intergranular α-phase disappears. A content of boron less than 0.2% is not enough for TiB to precipitate. A content of boron more than 1% causes TiB to precipitate excessively, resulting in poor ductility.

The sintered titanium alloy containing the above-mentioned elements has the three-phase structure composed of the α-phase, the β-phase, and particles of at least one of borides, oxide, and halides. The three-phase structure eliminates the coarse acicular α-phase and the intergranular α-phase, which decrease fatigue strength. Thus the sintered titanium alloy has the equiaxed α+β microstructure. This contributes to the high strength of the sintered titanium alloy.

A detailed description of this sintered titanium alloy is given below.

The sintered titanium alloy of the first embodiment is composed of 4–8% aluminum (Al), 2–6% vanadium (V), 0.2–1% boron (B), and 0.15–0.5% oxygen (O), with the balance being titanium and inevitable impurities, and has the three-phase structure of α-phase, β-phase, and boride particles (% meaning mass %).

This sintered titanium alloy has the equiaxed α-phase owing to the presence of titanium boride particles. It is inexpensive but it has a high strength. The strength will be higher if the α-phase have an aspect ratio smaller than 2.

The sintered titanium alloy of the second embodiment is composed of 4–8% aluminum (Al), 2–6% vanadium (V), 0.2–1% boron (B), 0.15–0.5% oxygen (O), and 0.5–3% of at least one of molybdenum (Mo), tungsten (W), tantalum (Ta), zirconium (Zr), niobium (Nb), and hafnium (Hf), with the balance being titanium and inevitable impurities, and has the three-phase microstructure of α-phase, β-phase, and boride particles (% meaning mass %).

This sintered titanium alloy has the equiaxed α-phase owing to the presence of titanium boride particles. Moreover, it has an extremely fine transgranular α phase owing to the presence of at least one element of Mo, W, Ta, Zr, Nb, and Hf. It is inexpensive but has a high strength.

The sintered titanium alloy of the third embodiment is composed of 4–8% aluminum (Al), 2–6% vanadium (V), 0.25–0.8% oxygen (O), and 0.5–2% of at least one of Ia Group elements such as sodium (Na) and potassium (K), IIa Group elements such as magnesium (Mg), calcium (Ca), and strontium (Sr), and IIIa Group elements such as scandium (Sc), yttrium (Y) , and cerium (Ce), with the balance being titanium and inevitable impurities, and has the three-phase microstructure of α-phase, β-phase, and oxide particles(% meaning mass %).

In this sintered titanium alloy, the Ia Group elements, IIa Group elements, and IIIa Group elements are present for the most part in the form of oxides, because they combine more easily with oxygen than titanium does. The oxide particles inhibit the grain growth of β-phase and function as the site for uniform nucleation at the time of β→α transformation, thereby making the transgranular α phase equiaxed and preventing the formation of the intergranular α phase. Thus the sintered titanium alloy is inexpensive but has a high strength.

The sintered titanium alloy of the fourth embodiment is composed of 4–8% aluminum (Al), 2–6% vanadium (V), 0.21% boron (B), 0.25–0.8% oxygen (O), 0.5–3% of at least one of molybdenum (Mo), tungsten (W), tantalum (Ta), zirconium (Zr), niobium (Nb), and hafnium (Hf), and 0.05–2% of at least one of Ia Group elements, IIa Group elements, and IIIa Group elements, with the balance being titanium and inevitable impurities, and has the three-phase microstructure of α-phase, β-phase, and boride and oxide particles (% meaning mass %).

In this sintered titanium alloy, the fine titanium boride particles and oxide particles inhibit the growth of β-phase grains and function as the site for uniform nucleation at the time of β→α transformation, thereby making the transgranular α phase equiaxed and preventing the formation of the intergranular α phase. Thus the sintered titanium alloy is inexpensive but has a high strength.

The sintered titanium alloy of the fifth embodiment is composed of 4–8% aluminum (Al), 2–6% vanadium (V), 0.15–0.5% oxygen (O), 0.05–2% of at least one of Ia Group elements, IIa Group elements, and IIIa Group elements, and 0.05–0.5% of at least one of halogens, with the balance being titanium and inevitable impurities, and has the three-phase texture of α-phase, β-phase, and halide particles (% meaning mass %).

This sintered titanium alloy has a high strength.

The sintered titanium alloy of the sixth embodiment is composed of 4–8% aluminum (Al), 2–6% vanadium (V), 0.15–0.5% oxygen (O), 0.5–3% of at least one of molybdenum (Mo), tungsten (W), tantalum (Ta), zirconium (Zr), niobium (Nb), and hafnium (Hf), 0.05–2% of at least one of Ia Group elements, IIa Group elements, and IIIa Group elements, and 0.05–0.5% of at least one of halogens, with the balance being titanium and inevitable impurities, and has the three-phase texture of α-phase, β-phase, and halide particles (% meaning mass %).

This sintered titanium alloy has a high strength.

The sintered titanium alloys mentioned above have the microstructure which is explained in the following with reference to FIGS. 1 to 3.

FIG. 1 is a schematic representation showing the microstructure of the sintered titanium alloys pertaining to the first, third, and fifth embodiments. They are composed of the equiaxed α-phase and β-phase and fine particles of at least one kind of titanium boride, oxide, and halide. In FIG. 1, the reference numeral 1 denotes the α-phase, the reference numeral 2 denotes the β-phase, and the reference numeral 3 denotes at least one of boride particles, oxide particles, and halide particles.

Figure 2:
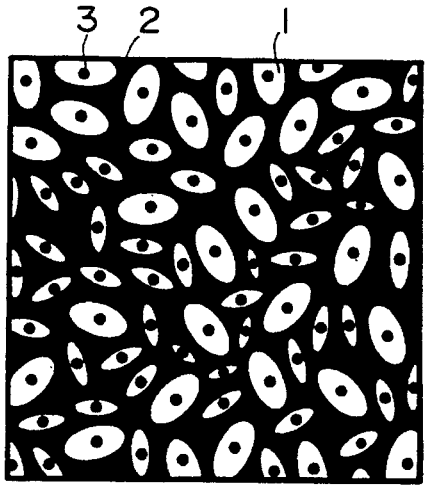
FIG. 2 is a schematic representation showing the microstructure of another sintered titanium alloy in one embodiment of the present invention.

FIG. 2 is a schematic representation showing the microstructure of the sintered titanium alloys pertaining to the second, fourth, and sixth embodiments. They contain at least one of Mo, W, Ta, Zr, Nb, and Hf, in addition to the components in the above-mentioned sintered titanium alloys pertaining to the first, third, and fifth embodiments. Therefore, they have a finer α-phase than those pertaining to the first, third, and fifth embodiments.

Figure 3:
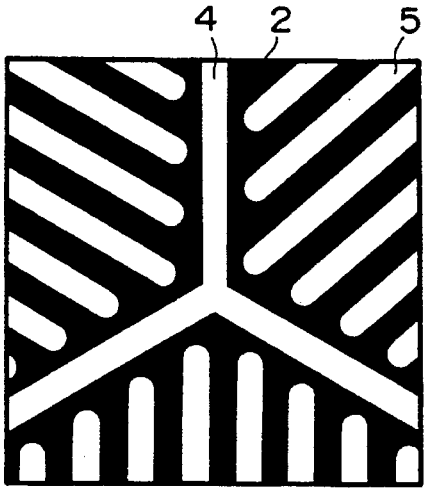
FIG. 3 is a schematic representation showing the microstructure of the α+β type sintered titanium alloy obtained by the conventional process.

FIG. 3 is a schematic representation showing the microstructure of the α+β type titanium alloy formed by the conventional process. It is composed of the intergranular α phase along the original β grain boundary and the coarse acicular transgranular α phase and β phase. In FIG. 3, the reference numeral 4 denotes the intergranular α phase, and the reference numeral 5 denote the transgranular α phase.

According to the method of the present invention, the α+β type sintered titanium alloy is produced by mixing a titanium powder with a powder for solid-solution hardening, compacting the mixture, and sintering the green compact under no pressure. This method is characterized by rubbing and pressing the tianium powder, thereby increasing the tap density of the raw material powder to a desired value and increasing the number of sites for the homogeneous nucleation which takes place when the titanium powder undergoes recrystallization and/or α→β transformation.

The outstanding effect of the method is due to the following mechanism, which is not completely elucidated yet.

The method involves an important step of rubbing and pressing the titanium powder before it is mixed with a powder for solid-solution hardening. This step is intended to obtain a raw material powder which has an increased tap density as desired. The rubbing and pressing smoothens the surface of the titanium particles (by pressing down projections). The rubbed powder improves in fluidity, resulting in a decrease in the size of cavity between particles of the raw material powder and an increase in tap density of the raw material powder. The thus prepared raw material powder yields, after compacting and sintering, a sintered titanium alloy containing extremely fine residual pores which are separated from one another.

In addition, the rubbing step accumulates a proper amount of strain energy in the titanium powder, thereby increasing the number of sites for homogeneous nucleation which takes place at the time of sintering and/or α→β transformation. This leads to a uniform distribution of the particle diameter of initial β grains, a marked decrease in grain growth rate (normal grain growth rate) in the β region, and a suppressed abnormal grain growth (secondary recrystallization). The next result is that the particle diameter of β grains does not increase easily even in the course of prolonged sintering. Excessive rubbing, however, produces an adverse effect such as the formation of substructure (aggregates of dislocations) and the uneven distribution of the particle diameter of initial β grains. A green compact with such defects does not yield a high-strength sintered body, because the normal grain growth rate is accelerated and the abnormal grain growth is liable to occur during heating in the β region, with the result that β grains become extremely coarse.

The above-mentioned rubbing step (agitating treatment) produces an effect of eliminating nating large residual pores. It is known that a titanium powder with a high chlorine content yields a sintered titanium alloy which is not so good in fatigue strength due to large residual pores even though it undergoes hot isostatic pressing. Therefore, lowering the chlorine content has been considered to be essential for a sintered titanium alloy to have improved mechanical properties. In fact, large pores are not due to chlorine itself but due to coarse particulate inclusions such as NaCl or $MgCl_2$. The rubbing step crushes and pulverizes such coarse inclusions, so that they are uniformly mixed with an inexpensive titanium powder. Thus the rubbing step makes it possible to eliminate the coarse residual pores which have been considered to be inevitable in the case where a high-chlorine titanium powder is employed.

The other effect of rubbing is the prevention of coarse acicular grains. Since the α phase grows through nucleation from the β phase grain boundary during cooling which follows sintering, the growth of the α phase can be stopped by the β phase grain boundary if the growth of β grains is suppressed during sintering.

As mentioned above, rubbing a titanium powder under pressure increases the tap density of the raw material powder to a desired level and also increases the number of sites for uniform nucleation that takes place when the titanium powder undergoes recrystallization and/or α→β transformation. Thus there is obtained a sintered titanium alloy containing fine closed residual pores and having a high density, fine microstructure, and improved fatigue strength.

According to the method of the present invention, it is possible to produce a high-strength titanium alloy comparable to an expensive ingot forging material, from an inexpensive titanium powder containing a large amount of impurities simply by sintering, without the need of hot isostatic pressing and heat treatment which lead to an increased production cost. Thus the method of the present invention provides a sintered titanium alloy which exhibits its economical advantage inherent in the sintered alloy and can be applied to cost-conscious mass-produced automotive parts.

According to the present invention, the sintered titanium alloy is produced by a method which comprises:

preparing a raw material powder from a titanium powder and a powder for solid-solution hardening, said titanium powder being composed of: 4–8% of aluminum (Al); 2–6% of vanadium (V); 0.15–0.5% of oxygen (O); at least one element selected from the group consisting of 0.2–1% of boron (B), 0.5–3% of at least one of molybdenum (Mo), tungsten (W), tantalum (Ta), zirconium (Zr), niobium (Nb), and hafnium (Hf), 0.05–2% of at least one of Ia Group elements, IIa Group elements, and IIIa Group elements, 0.05–0.5% of at least one of halogens; the balance being titanium (Ti) and inevitable impurities (% meaning mass %) (raw material powder preparing step);

rubbing and pressing the titanium powder, thereby increasing the tap-density of the raw material powder to a desired value and increasing the number of sites for homogeneous nucleation which takes place when the titanium powder undergoes recrystallization and/or α→β transformation (rubbing step);

mixing the raw material powder (raw material powder mixing step);

compacting the mixed powder (compacting step); and sintering the green compact under no pressure (sintering step).

The titanium powder and the powder for solid-solution hardening are powders to be made into the sintered titanium alloy. The titanium powder is one which is generally called pure titanium powder. Its typical examples include (a) sponge fines as a by-product of Hunter sponge titanium, (b) hydride-dehydride titanium powder produced by hydrogenation, crushing, and dehydrogenation of Kroll sponge titanium, and (c) extra low chlorine titanium powder produced by dissolution of Kroll sponge titanium for the removal of impurities, followed by hydrogenation, crushing, and dehydrogenation.

The mother alloy powder for solid-solution hardening is usually produced by crushing an ingot produced by plasma melting or arc melting. Therefore, the ingot should preferably have a composition which permits easy crushing. Typical compositions for the α+β alloy include Ti-Al-V, Ti-Al-V-Fe, Ti-Al-Sn-Zr-Mo, Ti-Al-V-Sn, and Ti-Al-Fe. To be more specific, it is composed of: 4–8% of aluminum (Al); 2–6% of vanadium (V); 0.15–0.5% of oxygen (O); at least one element selected from the group consisting of 0.21% of boron (B), 0.5–3% of at least one of molybdenum (Mo), tungsten (W), tantalum (Ta), zirconium (Zr), niobium (Nb), and hafnium (Hf), 0.05–2% of at least one of Ia Group elements, IIa Group elements, and IIIa Group elements, 0.05–0.5% of at least one of halogens; the balance being titanium (Ti) and inevitable impurities (% meaning mass %). The desired composition may be obtained by adding a boride powder, oxide powder, halide powder, or pure metal powder to the base alloy.

The following is the reason why the raw material should have a specific composition as mentioned above.

The content of aluminum should be 4–8 mass %. Aluminum is the most commonly used element for hardening of titanium alloys. It contributes to solid-solution hardening and α-phase stabilization. With a content less than 4% aluminum does not contribute to solid-solution hardening; and with a content more than 8%, aluminum extremely lowers ductility.

The content of vanadium should be 2–6 mass %. Vanadium is also commonly used for hardening of titanium alloys. It contributes to solid-solution hardening and β-phase stabilization. With a content less than 2%, vanadium does not contribute to solid-solution hardening; and with a content more than 6%, vanadium causes excessive β-phase stabilization.

The content of oxygen should be 0.15–0.8 mass %. In the case of ordinary titanium alloys, the oxygen content is strictly limited to 0.15% because oxygen lowers the ductility of titanium alloys. This is not true of sintered titanium alloys produced by the mixed powder method (although the reason is not known). In the latter case, oxygen lowers ductility only a little and produces an effect of hardening. With a content less than 0.15%, oxygen does not produce its effect of hardening; and with a content more than 0.8%, oxygen extremely lowers the ductility of the sintered titanium alloy.

The content of boron should be 0.2–1 mass %. Boron hardly dissolves in the titanium alloy but disperses for the most part into the matrix of the sintered body, forming fine TiB particles. (TiB may partly changes into $TiB_2$ if there is carbon, however small its amount may be.) The fine TiB particles inhibit the growth of β grains during sintering and promote the homogeneous nucleation of the α phase during cooling which follows sintering, with the result that the α-phase in the sintered body becomes equiaxed and the intergranular α-phase disappears. With a content less than 0.2%, boron does not permit TiB to precipitate sufficiently; with a content more than 1%, boron causes TiB to precipitate excessively, resulting in poor ductility.

The content of at least one of Mo, W, Ta, Zr, Nb, and Hf should be 0.5–3 mass %. They make the transgranular α-phase extremely fine after cooling, because they are very slow in diffusion into β-titanium alloy, they lower the β-transus temperature, and they lower the mobility of the β/α interface. With a content less than 0.5%, they do not produce the above-mentioned effect; and with a content more than 3%, they prevent the complete homogenization of components in the course of sintering and excessively lower the β-transus temperature.

The content of at least one of Ia Group elements such as sodium (Na) and potassium (K), IIa Group elements such as magnesium (Mg), calcium (Ca), and strontium (Sr), and IIIa Group elements such as scandium (Sc), yttrium (Y), and cerium (Ce) should be 0.05–2 mass %. In the sintered titanium alloy, these elements are present for the most part in the form of oxides or halides if oxygen or halogens exist in the titanium alloy, because they combine more easily with oxygen or halogens than titanium does. The oxide particles inhibit the growth of β-phase grains in the course of sintering and promote the nucleation of α-phase in the course of cooling that follows sintering. As the result, the transgranular α phase becomes equiaxed and the intergranular α phase disappears. With a content less than 0.05%, they do not form sufficient oxides or halides which precipitate; and with a content more than 2%, they form coarse oxide or halide particles which do not disperse uniformly.

The content of at least one halogen should be 0.05–0.5 mass %. In the titanium alloy, halogens combine with the Ia Group elements, IIa Group elements, and IIIa Group elements to form fine halide particles. The halide particles inhibit the growth of β-grains in the sintering step and promote the homogenous nucleation of α-phase in the cooling step that follows sintering, with the result that the α-phase in the sintered body becomes equiaxed and the intergranular α-phase disappears. With a total content less than 0.05%, halogens do not form sufficient halides to separate out; and with a total content more than 0.5%, halogens give rise to coarse halide particles which do not disperse uniformly but adversely affect ductility.

A marked effect is produced when the raw material powder has the composition as in the first to sixth embodiments shown above.

The fatigue strength of the sintered titanium alloy is determined by the amount of residual pores (or density), the size of residual pores, the strength of the alloy itself, and the notch sensitivity of the alloy (or liability to fatigue cracking). The amount of residual pores depends on the compact density and sinterability. The size of residual pores depends on the particle size of the raw material powder and the compactability and sinterability of the powder. An excessively coarse titanium powder is liable to form coarse pores which lower fatigue strength. A mother alloy powder for solid-solution hardening having a large average particle size has an adverse effect on the sinterability and hence gives rise to a sintered body with an insufficient density. Therefore, it is desirable that the maximum particle size of titanium powder should be smaller than 150 μm and the average particle size of the powder for solid-solution hardening should be smaller than 10 μm.

In the subsequent step, the titanium powder undergoes rubbing and pressing. This step makes the titanium powder to have a desired tap density. The rubbing and pressing smoothens the surface of the titanium particles (by pressing down projections). The rubbed powder improves in fluidity and has an increased tap density.

The tap density depends on the particle size distribution and particle shape of the powder. A desirable particle size distribution is such that there is a proper amount of medium and small particles which just fill pores among coarse particles. Even with such a desirable particle size distribution, the powder dose not improve in tap density if it is poor in fluidity. Sponge fines gives a tap density as low as about 1.5 g/cm$^3$, because it has a porous, irregular particle shape and hence is extremely poor in fluidity. Hydride-dehydride titanium powder gives a tap density of about 2.0 g/cm$^3$ at the highest, because it has an angular particle shape (resulting from grinding) and hence is by far inferior in fluidity to the ordinary atomized powder although slightly better than sponge fines. When the raw material powder in such a state undergoes compacting, particles can move very little owing to friction among particles but they are deformed where they are. This situation results in large pores in the green compact. After sintering, the large pores remain in the sintered compact, and they become the starting point of fatigue fracture. It is difficult to reduce the size of residual pores in the sintered body by increasing the compacting pressure and thereby increasing the density. To improve the fluidity of the powder, it is necessary to change the particle shape by this rubbing step so that the resulting powder gives a desired tap density.

The rubbing of the titanium powder should be carried out to such an extent that the tap density increases by more than 15% in the case of commercial titanium powder, by more than 30% in the case of sponge fines, or by more than 20% in the case of hydride-dehydride titanium powder or extra low chlorine titanium powder.

The tap density should preferably be in the range of 2.0–3.0 g/cm$^3$ so that the powder has an adequate degree of fluidity. With a tap density smaller than 2.0 g/cm$^3$, the sintered body still has some large pores and hence is not improved in fatigue strength satisfactorily. With a tap density in excess of 3.0 g/cm$^3$, the powder is extremely poor in formability.

The rubbing of the titanium powder should be carried out to such an extent that a tap density of 2.0–2.5 g/cm$^3$ is attained in the case of sponge fine and a tap density of 2.3–3.0 g/cm$^3$ is attained in the case of hydride-dehydride titanium powder or extra low chlorine titanium powder. The result is that pores larger than 50 μm in diameter (which could be the starting point for fatigue fracture) disappear and pores become closed ones having a diameter of about 20 μm at the largest. All this contributes to a great improvement in mechanical properties, especially ductility and fatigue strength.

With a tap density controlled within the above-mentioned range, it is possible to eliminate large pores even though compacting is carried out at such a low pressure as to permit a large number of pores to remain. Incidentally, the rubbing step should preferably be performed on the titanium powder alone to avoid contamination. However, it may be performed on a mixture of the titanium powder and powder for solid-solution hardening. In the latter case, it is also possible to produce an inexpensive, high-strength sintered titanium alloy.

The rubbing step is a light working to smoothen the powder surface by removing projections or to crush aggregate powder such as sponge fine. It may be accomplished by stirring the raw material powder for a short time (1–20 minutes) in an attritor or a ball mill containing steel balls. Rubbing presses down projections on the powder surface, thereby smoothening the powder surface. It is necessary to avoid excessive rubbing which crushes and pulverizes titanium powder particles or brings about work hardening. An excessively rubbed powder decreases in compactability and contains more oxygen.

The mixing of the raw material powder may be accomplished by using a ball mill, V-blender, or the like.

The compacting of the raw material powder may be accomplished by die pressing, cold isostatic pressing, or the like.

The sintering of the green compact should preferably be carried out at 1000°–1350° C. for 1–20 hours in consideration of the compactness of the sintered body, the homogeneity of the alloy composition, the durability of the furnace, and economy. The sintering atmosphere should be an inert gas (such as argon and helium) or vacuum (higher than $10^{-3}$ Torr) because the titanium alloy readily reacts with oxygen, nitrogen, and reducing gases.

Usually, the α+β type titanium alloy as cooled after sintering has a microstructure which is composed of the reticulate intergranular α phase along the original β grain boundary and the coarse acicular α phase in the original β grain. This is not true of the embodiment of the present invention in which the titanium alloy contains trace elements (such as boron, oxygen, Ia Group elements, IIa Group elements, IIIa Group elements, and halogen elements), because they form borides, oxides, or halides which precipitate in the form of fine particles in the matrix. The fine particles prevent the β grains from becoming coarse in the course of sintering and facilitate the nucleation of the α phase at the time of β→α transformation which takes place in the course of cooling. As the result, the microstructure after cooling has the equiaxed α phase and is free of the intergranular α phase.

The specific transition metals (Mo, W, Ta, Zr, Nb, and Hf) disperse into the titanium alloy very slowly, lower the β transus temperature, and lower the degree of β/α interface mobility. These actions make the transgranular α phase extremely fine after cooling.

Of the alloying elements, oxygen has been regarded as an element which reduces ductility. Therefore, efforts have been made to reduce the oxygen content in the titanium alloy. However, this is not true of the sintered titanium alloy produced by the mixed powder method, in which case as much oxygen as 0.15% (which is considered the upper allowable limit for ingot forging materials) can be present without any adverse effect on ductility, although the reason for this is not known.

The following description concerns the method for producing the sintered titanium alloy which is superior in strength, ductility, stiffness, wear resistance, and heat resistance.

In the course of their studies to solve problems involved in the prior art technology, the present inventors found that dispersing fine strengthening particles (which are substantially inert to the titanium alloy) into the titanium alloy matrix in large quantities is essential to improve the strength, wear resistance, stiffness, and heat resistance of a titanium alloy with minimum decrease in toughness and ductility of the alloy matrix.

The strengthening phase for the titanium alloy should meet the following requirements.

(1) Good mechanical properties such as strength, stiffness, wear resistance, and heat resistance.

(2) High bond strength at the interface between the titanium alloy matrix and the strengthening phase.

(3) Being in thermodynamic equilibrium with the titanium alloy (as the matrix) at a temperature at which the composite material is produced.

(4) Insoluble in and inert to the matrix of the titanium alloy. In the prior art technology, importance has been attached to only (1) and (2), and it has been a common practice to meet the requirements (3) and (4) by performing compacting at a low temperature at which reactions hardly occur or by coating the surface of the strengthening phase so as to avoid the interface reactions. The requirements (3) and (4) are also important in the production of the titanium-based composite material by the mixed powder method which employs an extremely high temperature.

Although U.S. Pat. No. 4,731,115 and Japanese Patent Laid-open No. 129330 cited above disclose TiC particles as the hardening phase for the titanium alloy, TiC particles do not meet the requirement (4). In other words, TiC particles react with the matrix, permitting carbon to dissolve in the matrix and hence lowering the ductility of the matrix. Therefore, TiC particles are not adequate as the hardening phase. Also, $TiB_2$ disclosed in U.S. Pat. No. 4,968,348 cited above does not meet the requirement (3), because it is not in thermodynamic equilibrium with the titanium alloy.

TiC and $TiB_2$ as the hardening phase for the titanium alloy matrix can be superseded by particles of yttrium oxide or rare earth metal oxide. The rapidly solidified powder alloy containing these particles dispersed therein is regarded as a promising light-weight heat-resistant material. This material, however, has problems associated with production, that is, the powder production costs too much and there are difficulties in dispersion of particles in large quantities and also in consolidation.

The present inventors found that TiB is an adequate hardening phase that meets all the requirements (1) to (4). In other words, TiB is in thermodynamic equilibrium with α and β titanium alloy matrices over a broad temperature range. Moreover, boron hardly dissolves in both the α and β matrices. The TiB/titanium matrix boundary is considered to have a high bonding strength because it has a coherent interface. The present inventors also found that boron produces a marked effect of promoting the sintering of the titanium alloy. These findings suggest the possibility that a high-density titanium-based composite material can be produced economically simply by sintering under no pressure. These ideas led to some preferred embodiments which are explained in the following.

According to the present invention, the preferred titanium-based composite material is composed of a matrix of α type, α+β type, or β type titanium alloy and a solid solution of TiB (5–50% by volume) dispersed in the matrix.

The titanium alloy matrix composite material of TiB dispersion type is superior to the conventional titanium-based composite material in strength, ductility, wear resistance, stiffness, and heat resistance. It is considered that this composite material produces its outstanding effect according to the following mechanism, which is not yet fully elucidated.

The titanium-based composite material is composed of a matrix of α type, α+β type, or β type alloy, and a strengthening phase which is a solid solution of TiB dispersed in the matrix. The solid solution of TiB dispersed in the base titanium alloy does not react with the titanium alloy. In addition, it hardly dissolves in the titanium alloy and does not undergo transformation even when the composite material is used at a high temperature. Therefore, the composite material remains stable. A conceivable reason for this is the extremely slow grain growth (Ostwald Ripening)at a high temperature which is due to the fact that the solid solution of TiB in combination with the β titanium matrix forms an coherent interface and boron hardly dissolves in the titanium alloy as mentioned above. These properties are very favorable to the production of the composite material. In other words, the titanium-based composite material of the present invention is never subject to the reaction between the matrix and the strengthening phase which makes the hardening particles coarse, even though sintering is performed at a high temperature for a long time. (Sintering is usually performed at a temperature of β single-phase region regardless of whether the titanium alloy is of α type, α+β type, or β type.)

According to the present invention, the amount of TiB particles to be dispersed in the titanium alloy matrix should be 5–50% by volume. With an amount less than 5%, TiB particles does not produce the effect of hardening. With an amount in excess of 50%, TiB particles become coarse and lower the toughens of the alloy.

For the reasons mentioned above, the titanium-based composite material in this embodiment retains good ductility and toughness and has improved strength, stiffness, heat resistance, and wear resistance over a broad temperature range.

The titanium-based composite material is explained in more detail in the following.

The titanium-based composite material is composed of a matrix of α type, α+β type, or β type titanium alloy and a solid solution of TiB (5–50% by volume) dispersed in the matrix. The base titanium alloy includes Ti-6Al-4V, Ti-10V-2Fe-3Al, Ti-6Al-2Sn-4Zr-6Mo, Ti-6Al-2Sn-4Zr-2Mo, Ti-6Al-6V-2Sn, etc. as well as pure titanium.

The solid solution of TiB is dispersed in the form of hard particles in the base alloy. Unlike TiC, TiN, and SiC, the solid solution of TiB hardly dissolves in the solid solution of titanium (either α or β), therefore, it remains stable so long as the titanium alloy contains boron up to about 50 ppm. In addition, the solid solution of TiB is in thermodynamic equilibrium with the solid solution of titanium over a broad temperature range from room temperature up to 1600° C. The interface between the TiB solid solution and the titanium solid solution is an coherent, and has a high interface strength. In other words, the TiB solid solution exhibits desirable properties when used as the strengthening phase for the titanium alloy.

The TiB solid solution should preferably be present in the base titanium alloy in the form of fine granular, dendritic, or acicular particles with an average particle diameter smaller than 20 μm. These shapes contribute to the improved toughness of the composite material.

According to the present invention, the particles of TiB solid solution having an average particle diameter smaller than 20 μm should be uniformly dispersed in the titanium alloy matrix in an amount of 5–50% by volume. The resulting titanium-based composite material will have good strength, ductility, stiffness, wear resistance, and heat resistance.

The titanium-based composite material (sintered titanium alloy) is produced by mixing a titanium powder, a hardening powder containing at least two metallic elements, and a powder containing boron, compacting the powder mixture, and sintering the thus obtained green compact under no pressure, so that the titanium alloy matrix contains 5–50% (by volume) TiB solid solution dispersed therein. The resulting titanium-based composite material (sintered titanium alloy) contains fine TiB particles dispersed in the titanium-based matrix and has superior strength, ductility, stiffness, wear resistance, and heat resistance. This method is more economical than the conventional one in the production of a high-performance composite material.

The marked effect of the method is due to the following mechanism, which is not completely elucidated yet.

The method for producing the titanium-based composite material involves the steps of mixing a titanium powder, a hardening powder containing at least two metallic elements, and a powder containing boron, compacting the powder mixture, and sintering the thus obtained green compact under no pressure. During sintering, the hardening powder and the elements other than boron in the boron-containing powder diffuse and dissolve in the titanium powder and the boron reacts with titanium to form TiB particles. These metallurgical reactions proceed in parallel with the sintering of the titanium powder. Finally, there is obtained a compact composite material which is constructed such that the hardening component is uniformly dissolved in the titanium alloy matrix and the TiB particles are uniformly dispersed in the titanium alloy matrix.

Boron greatly promotes the sintering of titanium, however small its amount may be. The TiB particles as the hardening phase are formed in the matrix by the reaction between the titanium powder and the boron-containing powder. These features are very favorable to the reduction of the production cost of the composite material.

Usually, the composite material of this kind is produced by incorporating the matrix alloy with the hardening phase itself. A disadvantage of this method is that the hardening phase in excess of a certain level prevents the matrix alloy from being sintered satisfactorily. Thus, in order to obtain a dense composite material, it is necessary to perform plastic deformation treatment (such as hot extrusion and hot forging) and pressing (such as hot isostatic pressing and hot pressing). These post treatments lead to an increased production cost.

By contrast, according to the method of the present invention, the hardening phase itself is not added, but it is formed in the matrix by the reaction between a powder (as the boron source) and a titanium powder. In addition, boron greatly promotes the sintering of titanium, although the reason for this is not known well. These synergistic effects permit the production of a compact composite material (having an apparent density close to a true density) simply by sintering under no pressure, even though the hardening phase is dispersed in large quantities. Therefore, this method is favorable for the economical production of the titanium-based composite material.

The thus obtained titanium-based composite material (titanium sintered alloy) contains 5–50% (by volume) TiB solid solution dispersed in the titanium alloy matrix and hence exhibits improved strength, stiffness, and wear resistance over a broad temperature range.

The following is a more detailed description of the method for producing the titanium-based composite material.

The method involves the steps of mixing a titanium powder with a hardening powder containing at least two metallic elements and a powder containing boron, compacting the mixed powder, and sintering the green compact under no pressure. The resulting titanium-based composite material contains 5–50% (by volume) TiB solid solution dispersed in the titanium alloy matrix.

The feature of this method is that the hardening component is added in a specific form so as to control the microstructure of the matrix and hardening phase.

The titanium-based composite material may be produced by melting, casting, or powder metallurgy. The last method is preferable because the first two methods are not suitable for the uniform dispersion of hard particles. The powder metallurgy permits the uniform dispersion of fine TiB particles into the titanium alloy.

The powder metallurgy is classified into the alloyed powder method and the mixed powder method. An advantage of the former is that fine particles of TiB solid solution are uniformly dispersed in the titanium matrix after hot isostatic pressing if the alloyed powder is previously incorporated with boron. However, it has a disadvantage that the titanium alloy incorporated with more than 5 mass % boron has such a high melting point (above 2000° C.) that it presents difficulties in powder making. In other words, the alloyed powder method is limited in the amount of the particles of TiB solid solution to be dispersed. Moreover, it leads to a high production cost.

By contrast, the mixed powder method is more favorable than the alloyed powder method for the economical production of the titanium-based composite material, because it involves the mixing of a titanium powder with an alloy powder for hardening, which is followed by compacting and sintering. This method permits the addition of boron up to 18% (theoretically), which is equivalent to 100% in terms of TiB.

The titanium powder used in this method is one which is generally called pure titanium powder. Its typical examples include (a) sponge fines as a by-product of Hunter sponge titanium, (b) hydride-dehydride titanium powder produced by hydrogenation, crushing, and dehydrogenation of Kroll sponge titanium, and (c) extra low chlorine titanium powder produced by melting Kroll sponge titanium for the removal of impurities, followed by hydrogenation, crushing, and dehydrogenation.

The method for producing the titanium-based composite material involves the steps of mixing a titanium powder, a mother alloy powder for solid-solution hardening containing at least two metallic elements, and a boron powder, compacting the mixed powder, and sintering the green compact under no pressure. The resulting titanium-based composite material contains 5–50% (by volume) TiB solid solution dispersed in the titanium alloy matrix.

The mother alloy powder for hardening is intended to strengthen the titanium alloy matrix. It is usually produced economically by crushing an ingot produced by plasma melting or arc melting. Therefore, the ingot should preferably have a composition which permits easy crushing. Typical compositions include Ti-Al-V, Ti-Al-V-Fe, Ti-Al-Sn-Zr-Mo, Ti-Al-V-Sn, and Ti-Al-Fe. The boron powder may be produced by crushing amorphous or crystalline boron.

According to this method, the titanium powder, mother alloy powder for hardening, and boron powder are mixed in a prescribed ratio, and the mixed powder is compacted and the green compact is sintered under no pressure. As the sintering of titanium proceeds, the components for solid-solution hardening disperse into titanium and becomes alloyed with titanium and the boron combines with titanium to form fine TiB particles of solid solution which disperse into the matrix. The resulting titanium-based composite material contains 5–50% (by volume) TiB solid solution dispersed in the titanium alloy matrix.

The boron thus added promotes the sintering of the titanium powder. Therefore, this method permits the economical production of a high-density composite material by sintering under no pressure.

The titanium-based composite material may also be produced by mixing a titanium powder with a mother alloy powder containing at least two metallic elements and boron, followed by compacting and sintering under no pressure. The thus obtained titanium-based composite material contains 5–50% (by volume) TiB solid solution dispersed in the titanium alloy matrix.

The mother alloy powder for hardening performs the solid-solution hardening of the titanium alloy matrix and also supplies boron to form TiB particles. Therefore, it should preferably contain boron and elements for the solid-solution hardening of titanium, such as at least two metallic elements selected from Al, V, Sn, Zr, Mo, and Fe. Moreover, it should preferably have such a composition as to facilitate melting and mechanical crushing.

In the course of sintering, the components for solid-solution hardening diffuse into titanium and becomes alloyed with titanium, and the boron combines with titanium to form fine TiB solid solution which disperses into the matrix. Thus there is obtained the titanium-based composite material containing 5–50% (by volume) TiB solid solution dispersed in the matrix of titanium alloy.

An advantage of this method is that the reaction of the components (other than boron) with titanium and the formation of TiB particles take place simultaneously when the boron-containing powder reacts with titanium. The reaction involved in this method is milder than the direct reaction of the boron powder with the titanium powder which is involved in the third embodiment. The mild reaction is less liable to the formation of voids resulting from the Kirkendall effect. This leads to a higher density.

There is another method for producing the titanium-based composite material. This method involves the mixing of a titanium powder, a mother alloy powder for solid-solution hardening containing at least two metallic elements, and at least one kind of powder of boride of IVa Group elements (Ti, Zr, and Hf), Va Group elements (V, Nb, and Ta), VIa Group elements (Cr, Mo, and W), or VIII Group elements (Fe, Co, and Ni), which is followed by compacting and sintering under no pressure. The resulting titanium-based composite material contains 5–50% (by volume) TiB solid solution dispersed in the matrix of titanium alloy.

The mother alloy powder for solid-solution hardening available for the conventional inexpensive sintered titanium alloy produced by the mixed powder method has been limited to Ti-6Al-4V, Ti-6Al-2Sn-4Zr-6Mo, Ti-6Al-2Sn-4Zr-2Mo, Ti-5Al-2.5Sn, Ti-6Al-6V-2Sn, etc. which are intended for α type or α+β type titanium alloy. This is due to the following problem involved in the production of the mother alloy powder. Since β type titanium alloys contain aluminum in a small quantity but transition metals in a large quantity, they are too ductile to be pulverized by the inexpensive crushing method. However, this is not the case if two or more mother alloys are used in combination. For example, a mother alloy powder for Ti-10V-2Fe-3Al alloy may be produced from Fe-V mother alloy and Al-V mother alloy by the inexpensive crushing method. This is applicable only to some of the near β type titanium alloys. For the ordinary β type titanium alloy, it is necessary to prepare the mother alloy powder by the expensive method other than the crushing method.

This disadvantage is eliminated by adding boron in the form of powder of boride of elements belonging to IVa, Va, VIa, and VIII Groups. Such a boride powder contains elements for β stabilization. Thus this method permits the production of the titanium-based composite material with β matrix.

According to this method, boron is added in the form of powder of boride of elements belonging to IVa, Va, VIa, and VIII Groups. The boron thus added reacts with titanium during sintering to form fine TiB particles. At the same time, the elements belonging to IVa, Va, VIa, and VIII Groups dissolve in the titanium matrix. Most of the elements (excluding titanium) belonging to IVa, Va, VIa, and VIII Groups perform β stabilization on the titanium alloy. Therefore, this method has control over the microstructure of the matrix alloy.

This method employs the mother alloy powder for solid-solution hardening which is the same as the one mentioned above. There are no restrictions as to the powder of boride of elements belonging to IVa, Va, VIa, and VIII Groups. It may be commercially available in the form of fine powder.

The process starts with the mixing of the titanium powder, mother alloy powder for solid-solution hardening, and boride powder, which is followed by compacting and sintering. As the sintering of titanium proceeds, each component in the powder for solid-solution hardening diffuses in and becomes alloyed with titanium, boron in the boride combines with titanium to form fine TiB solid solution which disperses in the matrix, and the IVa, Va, VIa, and VIII Group elements in the boride diffuse in and become alloyed with titanium, because the borides (except TiB) are not in thermodynamic equilibrium with the titanium alloy and they usually have an absolute value of standard free energy of formation which is smaller than that of titanium boride.

The IVa, Va, VIa, and VIII Group elements mostly become alloyed with titanium to stabilize the β phase. This means that it is possible to utilize the β alloy as the matrix of the titanium-based composite material although its use has been limited because of difficulties in crushing the mother alloy.

The titanium-based composite material of the present invention has a high strength owing to the synergistic effect produced by the hardening of the matrix alloy and the strengthening by the TiB particles. In general, the higher the strength, the more significant becomes the effect of residual pores on the mechanical properties. In other words, it is necessary to reduce the amount and size of residual pores to a minimum. The amount of residual pores depends on the density and sinterability of the green compact. The size of residual pores is concerned with the particle diameter, compactability, and sinterability of the raw material powder. As the titanium powder increases in particle diameter, it is liable to form coarser residual pores. If the powder for solid-solution hardening has an excessively large particle diameter, the resulting sintered body has a low density because of its poor sinterability. Therefore, the titanium powder should preferably have a maximum particle diameter smaller than 150 μm, and the powder for solid-solution hardening should preferably have an average particle diameter smaller than 10 μm.

The above-mentioned method permits the economical production of the titanium-based composite material which maintains good ductility, toughness, strength, stiffness, and wear resistance over a broad temperature range from room temperature and high temperatures.

There is another preferred method for producing the titanium-based composite material. It involves the steps of:

preparing a raw material powder from a titanium powder and a powder for solid-solution hardening (raw material powder preparing step);

rubbing and pressing the titanium powder, thereby increasing the tap density of the raw material powder to a desired value (rubbing step);

mixing the raw material powder (raw material powder mixing step);

compacting the mixed powder (compacting step); and sintering the green compact under no pressure (sintering step).

This method is characterized by the rubbing step, in which particles of the titanium powder are rubbed against one another under some pressure so that the titanium powder attains a desired tap density. Rubbing deforms particles of the titanium powder and presses down projections on the surface of particles of the titanium powder, thereby smoothening the particle surface. The rubbed powder improves in fluidity and forms smaller pores between particles, which leads to an increased tap density. The improved fluidity and increased tap density lead to a sintered body having extremely fine residual pores.

It is known that a titanium powder with a high chlorine content yields a sintered titanium alloy which contains large residual pores even though it undergoes hot isostatic pressing. Therefore, lowering the chlorine content has been considered to be essential for a sintered titanium alloy to have improved mechanical properties. In fact, large pores are not due to chlorine itself but due to coarse particulate inclusions such as NaCl or $MgCl_2$. The rubbing step crushes and pulverizes such coarse inclusions, so that they are uniformly mixed with an inexpensive high-chlorine titanium powder. Thus the rubbing step makes it possible to eliminate the coarse residual pores which have been considered to be inevitable in the case where a high-chlorine titanium powder is employed.

The tap density depends on the particle size distribution and particle shape of the powder. A desirable particle size distribution is such that there is a proper amount of medium and small particles which just fill pores among coarse particles. Even with such a desirable particle size distribution, the powder dose not improve in tap density if it is poor in fluidity. Sponge fine gives a tap density as low as about 1.5 g/cm$^3$, because it has a porous, irregular particle shape and hence is extremely poor in fluidity. Hydride-dehydride titanium powder gives a tap density of about 2.0 g/cm$^3$ at the highest, because it has an angular particle shape (resulting from grinding) and hence is by far inferior in fluidity to the ordinary atomized powder although slightly better than sponge fines. When the raw material powder in such a state undergoes compacting, particles can move very little owing to friction among particles but they are deformed where they are. This situation results in large pores in the green compact. After sintering, the large pores remain in the sintered compact, and they become the starting point of fatigue fracture. It is difficult to reduce the size of residual pores in the sintered body by increasing the compacting pressure and thereby increasing the density. To improve the fluidity of the powder, it is necessary to change the particle shape by this rubbing step so that the resulting powder gives a desired tap density.

The rubbing of the titanium powder should be carried out to such an extent that the tap density increases by more than 15% in the case of commercial titanium powder, by more than 30% in the case of sponge fine, or by more than 20% in the case of hydride-dehydride titanium powder or extra low chlorine titanium powder.

The tap density should preferably be in the range of 2.0–3.0 g/cm$^3$ so that the powder has an adequate degree of fluidity. With a tap density smaller than 2.0 g/cm$^3$, the sintered body still has some large pores and hence is not improved in fatigue strength satisfactorily. With a tap density in excess of 3.0 g/cm$^3$, the powder is extremely poor in formability.

The rubbing of the titanium powder should be carried out to such an extent that a tap density of 2.0–2.5 g/cm$^3$ is attained in the case of sponge fine and a tap density of 2.3–3.0 g/cm$^3$ is attained in the case of hydride-dehydride titanium powder or extra low chlorine titanium powder. The result is that large pores which could be the starting point for fatigue fracture disappear and pores become closed ones having a diameter of about 10 μm at the largest. All this contributes to a great improvement in mechanical properties, especially strength and ductility.

Incidentally, the rubbing step should preferably be performed on the titanium powder alone to avoid contamination. However, it may be performed on a mixture of the titanium powder and the mother alloy powder for solid-solution hardening. In the latter case, it is also possible to produce economically the titanium-based composite material having good strength, ductility, stiffness, wear resistance, and heat resistance.

The rubbing step is a light working to smoothen the powder surface by removing projections or to crush aggregate powder such as sponge fine. It may be accomplished by stirring the raw material powder for a short time (1–20 minutes) in an attritor or a ball mill containing steel balls. Rubbing presses down projections on the powder surface, thereby smoothening the powder surface. It is necessary to avoid excessive rubbing which crushes and pulverizes titanium powder particles or brings about work hardening. An excessively rubbed powder decreases in compactability and contains more oxygen.

As mentioned above, rubbing and pressing a titanium powder increase the tap density of the raw material powder to a desired level and also makes the residual pores fine and closed. Thus there is obtained the titanium-based composite material having good strength, ductility, wear resistance, stiffness, and heat resistance.

According to the method of the present invention, it is possible to produce the titanium-based composite material, which is superior in strength, ductility, stiffness, wear resistance, and heat resistance to an expensive titanium-based composite material produced by the ingot method, from an inexpensive titanium powder containing a large amount of impurities simply by sintering, without the need of hot isostatic pressing and heat treatment which lead to an increased production cost. Thus the method of the present invention provides the titanium-based composite material which exhibits its economical advantage inherent in the sintered alloy and can be applied to cost-conscious mass-produced automotive parts.

The above-mentioned method for producing the titanium-based composite material may be advantageously combined with the method for producing the previously mentioned titanium-based composite material characterized by its raw material powder. The combination of the two methods will produce a synergistic effect of their features.

The mixing of the raw material powder may be accomplished by using a ball mill, V-blender, or the like.

The compacting of the raw material powder may be accomplished by die pressing, cold isostatic pressing, or the like.

The sintering of the green compact should preferably be carried out at 1200°–1400° C. for 2–50 hours in consideration of the compactness of the sintered body, the homogeneity of the alloy composition, the distribution of TiB particles, the durability of the furnace, and economy. The sintering atmosphere should be an inert gas (such as argon and helium) or vacuum (higher than $10^{-3}$ Torr) because the titanium alloy readily reacts with oxygen, nitrogen, hydrogen and reducing gases.

EXAMPLES

The invention will be described in more detail with reference to the following examples.

EXAMPLE 1

High-chlorine pure titanium powder (−100 mesh sponge fines composed of 99.6% Ti, 0.1% O, 0.1% Cl, and 0.08% Na), along with steel balls, was placed in an attritor, and the titanium powder underwent stirring for 10 minutes. The stirred titanium powder gave a tap density of 2.30 g/cm$^3$, which is 43% higher than the original one. The stirred titanium powder was mixed with an Al-40% V powder having an average particle diameter of 7 μm in the ratio of 9:1 by weight. The mixture was compacted by cold isostatic pressing at 4 tons/cm$^2$. The green compact was sintered in vacuo ($10^{-5}$ Torr) at 1300° C. for 4 hours. Thus there was obtained a sintered titanium alloy (Sample No. 1).

Figure 4:
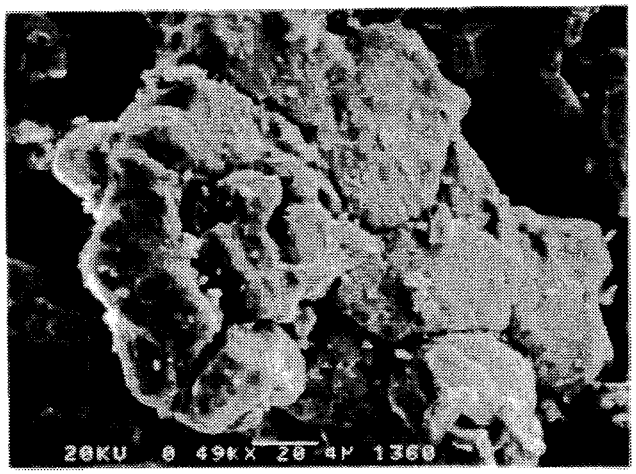
FIG. 4 is a 500× SEM (scanning electron microscope) photograph showing the particulate structure of the titanium powder which has undergone the agitating treatment in Example 1 of the present invention.
Figure 5:
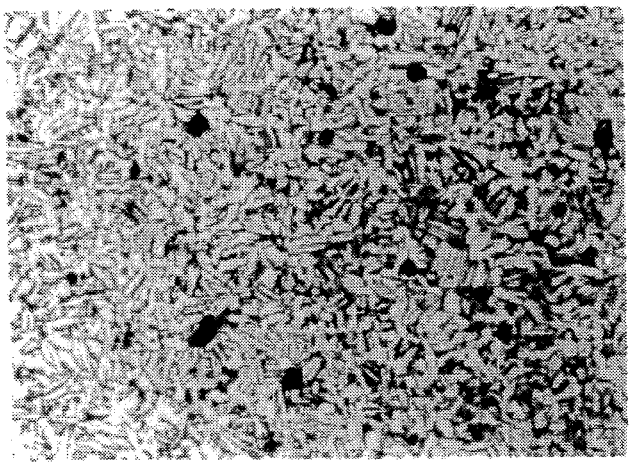
FIG. 5 is a 200× photomicrograph showing the microstructure of the sintered titanium alloy obtained in Example 1 of the present invention.

The stirred titanium powder gave a particle structure as shown in FIG. 4 which is a 500× SEM photograph. The sintered body gave a microstructure shown in FIG. 5 which is a 200× microphotograph. It is noted from FIG. 4 that the particles of the titanium powder have surface irregularities smoothened by stirring (rubbing and pressing). It is noted from FIG. 5 that the sintered titanium alloy has residual pores reduced in size and the α-phase equiaxed.

EXAMPLE 2

Low-chlorine pure titanium powder (−100 mesh hydride-dehydride titanium powder composed of 99.8% Ti, 0.2% O, and 0.01% Cl) and 0.2% $Y_2O_3$ powder, along with steel balls, were placed in an attritor, and the titanium powder underwent stirring for 10 minutes. The stirred titanium powder gave a tap density of 2.7 g/cm$^3$, which is 24% higher than the original one. The stirred titanium powder was mixed with an Al-40% V powder having an average particle diameter of 7 μm in the ratio of 9:1 by weight. The mixture underwent compacting and sintering in the same manner as in Example 1. Thus there were obtained two kinds of sintered titanium alloy (Sample Nos. 2 and 3), one prepared from titanium powder having an average particle diameter of 60 μm and the other prepared from titanium powder having an average particle diameter of 80 μm.

EXAMPLE 3

The same low-chlorine pure titanium powder (having an average particle diameter of 60 μm) as used in Example 2 and 0.2% $YCl_3$ powder underwent stirring in the same manner as in Example 1. The stirred titanium powder was mixed with 10% Al-40% V powder, and the mixture underwent compacting and sintering in the same manner as in Example 1. Thus there was obtained a sintered titanium alloy (Sample No. 4).

EXAMPLE 4

The same low-chlorine pure titanium powder (having an average particle diameter of 80 μm) as used in Example 2 powder underwent stirring in the same manner as in Example 1. The stirred titanium powder was mixed with 0.2% $YCl_3$ powder and 10% Al-40% V powder, and the mixture underwent compacting and sintering in the same manner as in Example 1. Thus there was obtained a sintered titanium alloy (Sample No. 5).

EXAMPLE 5

The same high-chlorine pure titanium powder as used in Example 1 underwent stirring in the same manner as in Example 1. The stirred titanium powder was mixed with 0.5% $TiB_2$ powder, 1% Mo powder, and 10% Al-40% V powder. The mixture underwent compacting and sintering in the same manner as in Example 1. Thus there was obtained a sintered titanium alloy (Sample No. 6).

Figure 6:
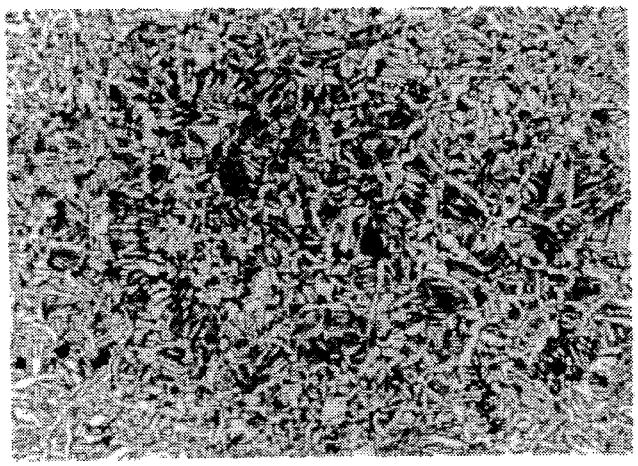
FIG. 6 is a 200× photomicrograph showing the microstructure of the sintered titanium alloy obtained in Example 5 of the present invention.

The sintered body gave a microstructure as shown in FIG. 6 which is a 200× microphotograph. It is noted from FIG. 6 that the sintered titanium alloy has much smaller residual pores than that in Example 1 and also has an extremely fine α+β structure.

EXAMPLE 6

The same low-chlorine pure titanium powder as used in Example 2 underwent stirring in the same manner as in Example 1. The stirred titanium powder was mixed with 0.2% $YCl_3$ powder, 1% W powder, and 10% Al-40% V powder. The mixture underwent compacting and sintering in the same manner as in Example 1. Thus there was obtained a sintered titanium alloy (Sample No. 7).

EXAMPLE 7

Low-chlorine pure titanium powder (−100 mesh hydride-dehydride titanium powder composed of 99.8% Ti, 0.3% O, and 0.01% Cl), which contains more oxygen than that used in Example 2, underwent stirring in the same manner as in Example 1. The stirred titanium powder was mixed with 10% Al-40% V-2% Ca powder. The mixture underwent compacting and sintering in the same manner as in Example 1. Thus there was obtained a sintered titanium alloy (Sample No. 8).

EXAMPLE 8

The same high-oxygen, low-chlorine pure titanium powder as used in Example 7 underwent stirring in the same manner as in Example 1. The stirred titanium powder was mixed with 1% Mo powder and 10% Al-40% V-2% Ca powder. The mixture underwent compacting and sintering in the same manner as in Example 1. Thus there was obtained a sintered titanium alloy (Sample No. 9).

COMPARATIVE EXAMPLE 1

The same high-chlorine pure titanium powder as used in Example 1 was mixed with Al-40% V powder having an average particle diameter of 40 μm. The mixture without stirring underwent compacting and sintering in the same manner as in Example 1. Thus there was obtained a sintered body for comparison (Sample No. C1).

Figure 7:
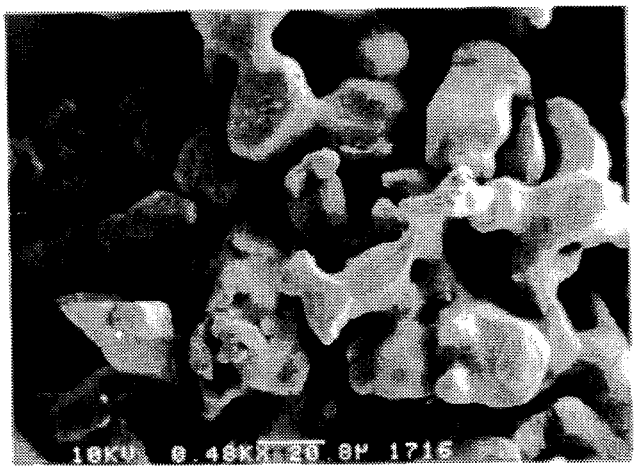
FIG. 7 is a 500× SEM photograph showing the particulate structure of the titanium powder in Comparative Example 1.
Figure 8:
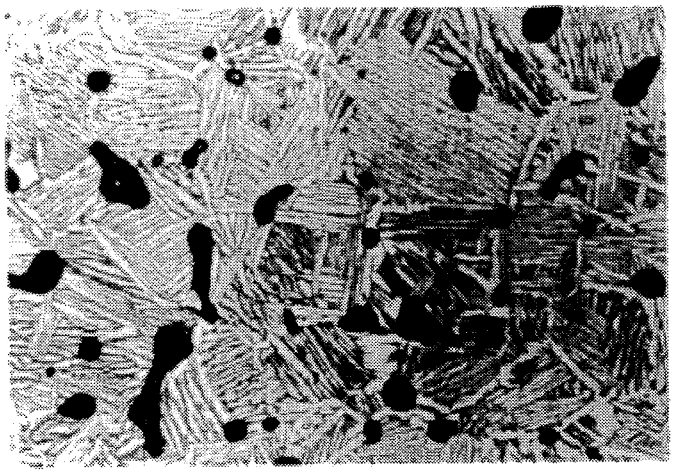
FIG. 8 is a 200× photomicrograph showing the microstructure of the sintered body prepared in Comparative Example 1.

The titanium powder gave a particle structure as shown in FIG. 7 which is a 500× SEM photograph. The sintered body gave a microstructure as shown in FIG. 8 which is a 200× microphotograph. It is noted from FIG. 7 that the particles of the titanium powder have rugged surface irregularities and large pores between particles. It is noted from FIG. 8 that the sintered body for comparison has a large number of coarse residual pores and the α-phase in the form of large acicular morphology.

COMPARATIVE EXAMPLE 2

The same high-chlorine pure titanium powder as used in Example 1 was mixed with Al-40% V powder having an average particle diameter of 7 μm. The mixture without stirring underwent compacting and sintering in the same manner as in Example 1. Thus there was obtained a sintered body for comparison (Sample No. C2).

COMPARATIVE EXAMPLE 3

The same low-chlorine pure titanium powder as used in Example 2 was mixed with Al-40% V powder having an average particle diameter of 40 μm. The mixture without stirring underwent compacting and sintering in the same manner as in Example 1. Thus there was obtained a sintered body for comparison (Sample No. C3).

microstructure, tensile strength, and fatigue strength. The results are shown in Table 1. It is noted form Table 1 that the samples in Examples are superior to those in Comparative Examples in density, tensile strength, elongation, and fatigue strength.

TABLE 1

| Sample No. | Tap density (g/cm$^3$) | Sintered density (%) | Maximum pore diameter (μm) | Tensile strength (kg/mm$^2$) | Elongation (%) | Fatigue strength (kg/mm$^2$) | micro-structure |
|---|---|---|---|---|---|---|---|
| 1 | 2.30 | 99.3 | 20 | 87 | 15 | 42 | equiaxed |
| 2 | 2.55 | 99.0 | 10 | 94 | 14 | 39 | equiaxed |
| 3 | 2.70 | 99.0 | 10 | 95 | 15 | 43 | equiaxed |
| 4 | 2.51 | 99.6 | 10 | 96 | 15 | 44 | equiaxed |
| 4 | 2.70 | 99.3 | 10 | 97 | 13 | 40 | equiaxed |
| 6 | 2.30 | 99.4 | 15 | 103 | 11 | 52 | fine equi-axed |
| 7 | 2.70 | 99.2 | 8 | 110 | 8 | 54 | fine equi-axed |
| 8 | 2.70 | 98.8 | 15 | 105 | 8 | 46 | equiaxed |
| 9 | 2.70 | 99.1 | 10 | 108 | 10 | 50 | fine equi-axed |
| C1 | 1.52 | 96.0 | 100 | 79 | 4 | 18 | coarse acicular |
| C2 | 1.52 | 99.1 | 50 | 84 | 5 | 23 | coarse acicular |
| C3 | 2.18 | 95.1 | 80 | 91 | 10 | 26 | coarse acicular |
| C4 | 2.18 | 99.1 | 50 | 98 | 12 | 29 | coarse acicular |
| C5 | 1.50 | 98.0 | 50 | 90 | 6 | 31 | coarse acicular |

COMPARATIVE EXAMPLE 4

The same low-chlorine pure titanium powder as used in Example 2 was mixed with Al-40% V powder having an average particle diameter of 7 μm. The mixture without stirring underwent compacting and sintering in the same manner as in Example 1. Thus there was obtained a sintered body for comparison (Sample No. C4).

COMPARATIVE EXAMPLE 5

The same high-chlorine pure titanium powder as used in Example 1 and Al-40% V powder having an average particle diameter of 7 μm, along with steel balls, were placed in an attritor, and stirring was performing for 60 minutes. The mixture underwent compacting and sintering in the same manner as in Example 1 to give a sintered body for comparison (Sample No. C5).

Figure 9:
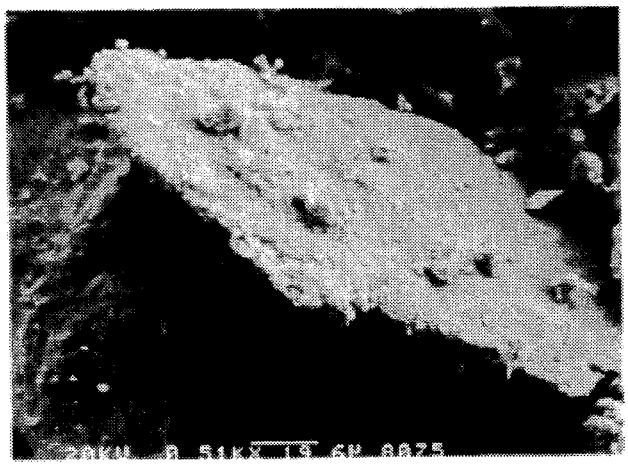
FIG. 9 is a 500× SEM photograph showing the particulate structure of the mixed powder which has undergone agitating treatment in Comparative Example 5.
Figure 10:
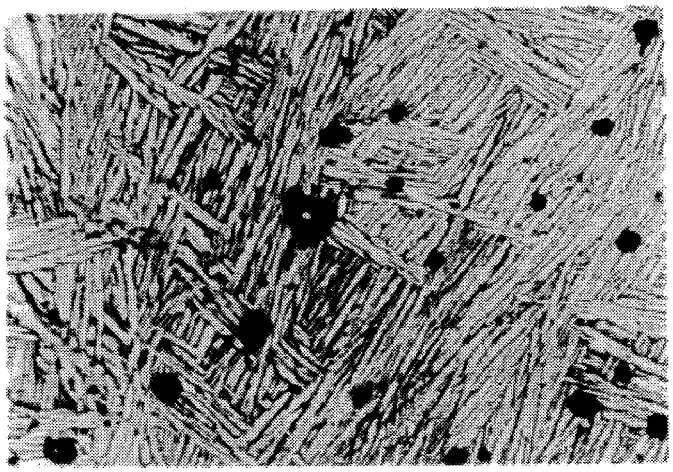
FIG. 10 is a 200× photomicrograph showing the microstructure of the sintered body prepared in Comparative Example 5.

The stirred mixed powder gave a particle structure as shown in FIG. 9 which is a 500× SEM photograph. The sintered body for comparison gave a microstructure as shown in FIG. 10 which is a 200× microphotograph. It is noted from FIG. 9 that the particles of the mixed powder are flattened due to excessive stirring. In fact, the stirred mixed powder gave a tap density of 1.50 g/cm$^3$, which is almost the same as that of the original one. It is noted from FIG. 10 that the sintered titanium alloy for comparison has large residual pores and hence a density decreased to 98%. This comparative example demonstrates that excessive stirring impairs the feature of the present invention.

Evaluation of the Sintered Bodies

The sintered bodies obtained in Examples 1 to 7 and Comparative Examples 1 to 5 were tested for tap density,

EXAMPLE 9

In an attritor were mixed for 10 minutes 670 g of −100 mesh titanium powder (composed of 99.6% Ti, 0.1% O, and 0.1% Cl), 70 g of Al-40% V powder having an average particle diameter of 7 μm, and 8.3 g of boron powder having an average particle diameter of 2 μm. The mixed powder was compacted by cold isostatic pressing at 4 tons/cm$^2$. The resulting green compact was sintered in vacuo ($10^{-5}$ Torr) at 1300° C. for 16 hours. Thus there was obtained a titanium alloy material composed of a Ti-Al-V alloy and 5.9 vol % platy TiB particles dispersed therein, having an average particle diameter of 5 μm. (Sample No. 10)

EXAMPLE 10

Figure 11:
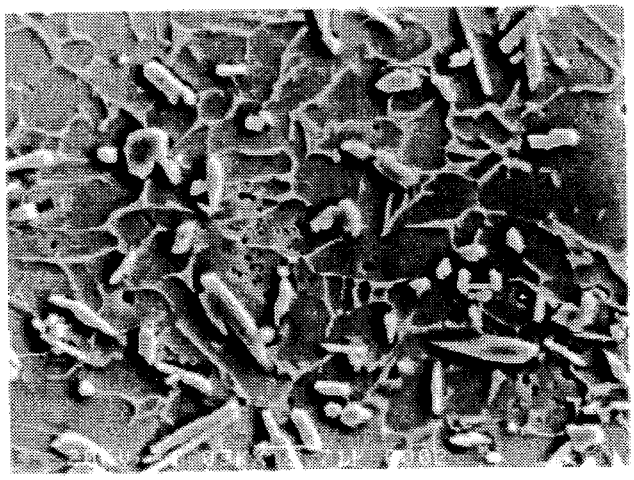
FIG. 11 is a 1000× SEM photograph showing the microstructure of the titanium-based composite material obtained in Example 9 of the present invention.

The same procedure as in Example 9 was repeated except that the amount of the pure titanium powder, Al-40% V powder, and boron power was changed to 667 g, 66 g, and 16.5 g, respectively. Thus there was obtained a titanium-based composite material composed of a Ti-Al-V alloy and 11.6 vol % platy TiB particles dispersed therein, having an average particle diameter of 10 μm. (Sample No. 11) This composite material gave a microstructure as shown in FIG. 11, which is a 1000× SEM photograph. It is noted from FIG. 11 that the titanium-based composite material in this example has a microstructure almost free of residual pores, with fine TiB particles uniformly dispersed therein.

EXAMPLE 11

The same procedure as in Example 9 was repeated except that the amount of the pure titanium powder, Al-40% V powder, and boron power was changed to 660 g, 60 g, and 28.5 g, respectively. Thus there was obtained a titanium-based composite material composed of a Ti-Al-V alloy and 20.22 vol % platy TiB particles dispersed therein, having an average particle diameter of 10 μm. (Sample No. 12)

EXAMPLE 12

The same procedure as in Example 9 was repeated except that the amount of the pure titanium powder and Al-40% V powder was changed to 599 g and 60 g, respectively, and the boron powder was replaced by 91.8 g of $TiB_2$ powder having an average particle diameter of 1 μm. Thus there was obtained a titanium-based composite material composed of a Ti-Al-V alloy and 21.03 vol % platy TiB particles dispersed therein, having an average particle diameter of 10 μm. (Sample No. 13)

EXAMPLE 13

The same procedure as in Example 9 was repeated except that the raw materials were replaced by 669 g of pure titanium powder (the same one as used in Example 9) and 77 g of Al-38% V-9.8% B powder having an average particle diameter of 7 μm. Thus there was obtained a titanium-based composite material composed of a Ti-Al-V alloy and 5.2 vol % platy TiB particles dispersed therein, having an average particle diameter of 5 μm. (Sample No. 14)

EXAMPLE 14

The same procedure as in Example 9 was repeated except that the raw materials were replaced by 620 g of pure titanium powder (the same one as used in Example 9), 63 g of Al-40% V powder having an average particle diameter of 7 μm, and 33 g of CrB powder having an average particle diameter of 2 μm. Thus there was obtained a titanium-based composite material composed of a Ti-Al-V-Cr alloy and 10.2 vol % platy TiB particles dispersed therein, having an average particle diameter of 10 μm. (Sample No. 15)

COMPARATIVE EXAMPLE 6

The same procedure as in Example 9 was repeated except that the raw materials were replaced by 630 g of pure titanium powder (the same one as used in Example 9) and 70 g of Al-40% V powder. Thus there was obtained a titanium-based composite material for comparison composed of a Ti-Al-V alloy alone and with no hard particles dispersed therein. (Sample No. C6)

COMPARATIVE EXAMPLE 7

The same procedure as in Example 9 was repeated except that the raw materials were replaced by 630 g of pure titanium powder (the same one as used in Example 9), 70 g of Al-40% V powder, and 70 g of TiC powder having an average particle diameter of 20 μm. Thus there was obtained a titanium-based composite material for comparison composed of a Ti-Al-V alloy and 9.45 vol % TiC particles dispersed therein, having an average particle diameter of 40 μm. (Sample No. C7)

COMPARATIVE EXAMPLE 8

The same procedure as in Example 9 was repeated except that the raw materials were replaced by 630 g of pure titanium powder (the same one as used in Example 9), 70 g of Al-40% V powder, and 70 g of TiC powder having an average particle diameter of 1 μm. Thus there was obtained a titanium-based composite material for comparison composed of a Ti-Al-V alloy and 8.84 vol % TiC particles dispersed therein, having an average particle diameter of 10 μm. (Sample No. C8)

EVALUATION OF PERFORMANCE

The titanium-based composite materials obtained in Examples 9 to 14 and Comparative Example 6 to 8 were tested for wear resistance, Young's molulus, and tensile properties at room temperature and 600° C. Wear test was carried out using a pin-on-disk wear tester (normalized S45C abrader, without lubrication, load of 2 kg/cm$^2$, sliding speed of 0.5 m/s). The results are shown in Tables 2 and 3. It is noted from Tables 2 and 3 that the titanium-based composite materials of Examples are superior to those of Comparative Examples in wear resistance, Young's modulus, and tensile properties.

TABLE 2

| Sample No. | Hard particles (vol %) | Young's modulus at room temperature (kg/mm$^2$) | Young's modulus, 600° C. (kg/mm$^2$) |
|---|---|---|---|
| 10 | 5.9 | 12300 | 9400 |
| 11 | 11.68 | 13400 | 10300 |
| 12 | 20.22 | 14200 | 11500 |
| 13 | 21.03 | 14600 | 11700 |
| 14 | 5.2 | 12200 | 9000 |
| 15 | 10.20 | 13200 | 10300 |
| C6 | — | 11200 | 8500 |
| C7 | 9.45 | 9700 | 7700 |
| C8 | 8.84 | 12700 | 9500 |

TABLE 3

| | Tensile properties (room temperature) | | Tensile properties (at 600° C.) | | |
|---|---|---|---|---|---|
| Sample No. | Tensile strength (kg/mm$^2$) | Elongation (%) | Tensile strength (kg/mm$^2$) | Elongation (%) | Wear loss (mg/km) |
| 10 | 98 | 8 | 40 | 5 | 2.5 |
| 11 | 105 | 5 | 47 | 7 | 1.4 |
| 12 | 118 | 3 | 53 | 9 | 0.8 |
| 13 | 121 | 3 | 55 | 8 | 0.8 |
| 14 | 96 | 10 | 39 | 8 | 2.8 |
| 15 | 103 | 6 | 45 | 7 | 0.1 |
| C6 | 93 | 15 | 32 | 5 | 16.0 |
| C7 | 72 | 0 | 22 | 1 | 1.5 |
| C8 | 81 | 1 | 33 | 4 | 1.9 |

What is claimed:

1. A method for producing a sintered titanium alloy which comprises the steps of:

mixing a raw material powder composed of a titanium powder and a mother-alloy powder;

rubbing and pressing the titanium powder before, during or after the mixing, so as to increase a tap density of the raw material powder to a desired value;

compacting the mixed powder to form a green compact; and sintering the green compact under no pressure.

2. A method for producing a sintered titanium alloy as defined in claim 1, wherein the rubbing and pressing step is performed by pressing down projections of the titanium powder to smoothen the surface of the titanium powder so as to improve fluidity of the raw material powder and thus increase the tap density of the powder, and by accumulating a strain energy in the titanium powder for increasing the number of sites for homogeneous nucleation when the titanium powder undergoes recrystallization and/or $\alpha \rightarrow \beta$ transformation during heating for sintering, so as to retard the normal and/or the abnormal growth rate of $\beta$ grain during the sintering procedure, whereby the obtained sintered titanium alloy contains extremely fine residual pores which are separated from one another and has a high density, fine microstructure and thus improved fatigue strength.

3. A method for producing a sintered titanium alloy as defined in claim 2, wherein the titanium powder has a maximum particle diameter smaller than 150 μm and the mother-alloy powder has an average particle diameter smaller than 10 μm, both measured before compacting.

4. A method for producing a sintered titanium alloy as defined in claim 2, wherein the rubbing and pressing step is performed such that the titanium powder is given a tap density increased by 15% or more.

5. A method for producing a sintered titanium alloy as defined in claim 4 wherein the titanium powder is sponge fines and the rubbing and pressing step is performed such that the titanium powder is given a tap density increased by 30% or more.

6. A method for producing a sintered titanium alloy as defined in claim 4, wherein the titanium powder is hydride-dehydride titanium powder and the rubbing and pressing step is performed such that the titanium powder is given a tap density increased by 20% or more.

7. A method for producing a sintered titanium alloy as defined in claim 2 wherein the rubbing and pressing step is performed such that the titanium powder has a tap density of 2.0–3.0 g/cm$^3$.

8. A method for producing a sintered titanium alloy as defined in claim 7, wherein the titanium powder is sponge fines and the rubbing and pressing step is performed such that the titanium powder has a tap density of 2.0–2.5,. g/cm$^3$.

9. A method for producing a sintered titanium alloy as defined in claim 7, wherein the titanium powder is hydride-dehydride titanium powder and the rubbing and pressing step is performed such that the titanium powder has a tap density of 2.3–3.0 g/cm$^3$.

10. A method for producing a sintered titanium alloy as defined in claim 2, wherein the sintering step is performed at 1000°–1350° C. for 1–20 hours in a vacuum higher than $10^{-3}$ Torr or an inert gas.

11. A method for producing a sintered titanium alloy as defined in claim 2, wherein the sintered titanium alloy is composed of a matrix of one of $\alpha$-type, $\alpha+\beta$-type, and $\beta$-type titanium alloy, and particles dispersed in the matrix which are thermodynamically stable at the sintering temperature.

12. A method for producing a sintered titanium alloy as defined in claim 1, which further comprises a step of preparing a raw material powder from the titanium powder and the mother-alloy powder such that the titanium alloy is composed of: 4–8 mass % of aluminum (Al); 2–6 mass % of vanadium (V); 0.15–0.5 mass % of oxygen (O); at least one element selected from the group consisting of 0.2–1 mass % of boron (B), 0.5–3 mass % of at least one of molybdenum (Ho), tungsten (W), tantalum (Ta), zirconium (Zr), niobium (Nb), and hafnium (Hf), 0.05–2 mass % of at least one of Ia Group elements, IIa Group elements, and IIIa Group elements, and 0.05–0.5 mass % of at least one of halogens; with the balance being titanium (Ti) and inevitable impurities, wherein the rubbing and pressing step is carried out so as to increase the number of sites for homogeneous nucleation when the titanium powder undergoes recrystallization and/or $\alpha \rightarrow \beta$ transformation during heating stage for sintering as well as to increase the tap density of the raw material powder, thereby producing a high strength of $\alpha+\beta$ type sintered titanium alloy.

13. A method for producing a sintered titanium alloy as defined in claim 1, wherein the raw material powder is composed of a titanium powder, a mother-alloy powder for solid-solution hardening, and a powder containing boron, whereby the obtained sintered titanium alloy is composed of a titanium alloy matrix and a TiB solid solution uniformly dispersed therein.

14. A method for producing a sintered titanium alloy as defined in claim 13, wherein the TiB solid solution has an average particle diameter of 20 μm or less.

15. A method for producing a sintered titaniun alloy as defined in claim 13, wherein the mother-alloy powder contains at least two metallic elements, and the powder containing boron is boron.

16. A method for producing a sintered-titanium alloy as defined in claim 15, wherein the mother-alloy powder contains at least two metallic elements selected from the group consisting of Al, V Sn, Zr, Mo and Fe.

17. A method for producing a sintered titanium alloy as defined in claim 13, wherein the mother-alloy powder and the powder containing boron comprise an alloy powder comprised of at least two metallic elements and boron.

18. A method for producing a sintered titanium alloy as defined in claim 13, wherein the mother-alloy powder contains at least two metallic elements, and the powder containing boron is at least one kind of powder of a boride of an element belonging to the Groups IVa, Va, Vla, and VIIIA of the Periodic Table.

19. A method for producing a sintered titanium alloy as defined in claim 13, wherein the rubbing and pressing step is performed such that the titanium powder is given a tap density increased by 15% or more.

20. A method for producing a sintered titanium alloy as defined in claim 19, wherein the titanium powder is sponge fines and the rubbing and pressing step is performed such that the titanium powder is given a tap density increased by 30% or more.

21. A method for producing a sintered titanium allow as defined in claim 19, wherein the titanium powder is hydride-dehydride titanium powder and the rubbing and pressing step is performed such that the titanium powder is given a tep density increased by 20% or more.

22. A method for producing a sintered titanium alloy as defined in claim 13, wherein the rubbing and pressing step is performed such that the titanium powder has a tap density of 2.0–3.0 g/cm$^3$.

23. A method for producing a sintered titanium alloy as defined in claim 22, wherein the titanium powder is sponge fines and the rubbing and pressing step is performed such that the titanium powder has a tap density of 2.0–2.5 b/cm$^3$.

24. A method for producing a sintered titanium alloy as defined in claim 22, wherein the titanium powder is hydride-dehydride titanium powder and the rubbing and presisng step is performed such that the titanium powder has a tap density of 2.3–3.0 g/cm$^3$.

25. A method for producing a sintered titanium alloy as defined in claim 13, wherein the sintering step is performed at 1200°–1400 ° C. for 2–50 hours in a vacuum higher than $10^{-3}$ Torr or inert gas.

* * * * *